United States Patent [19]

Sieghartner

[11] 4,178,131

[45] Dec. 11, 1979

[54] CENTRIFUGAL IMPELLERS

[75] Inventor: Leonard J. Sieghartner, Coal Valley, Ill.

[73] Assignee: Roy E. Roth Company, Rock Island, Ill.

[21] Appl. No.: 931,481

[22] Filed: Aug. 7, 1978

[51] Int. Cl.[2] ..... F04D 13/12; F04D 24/18

[52] U.S. Cl. ..... 416/175; 416/186 A; 416/189; 415/143; 415/DIG. 3

[58] Field of Search ..... 416/175, 186 R, 186 A, 416/187, 179, 189 R, 191; 415/91, 122 A, 143, 199.6, 213 R, 213 B, 213 C, DIG. 3

[56] References Cited

U.S. PATENT DOCUMENTS

| | | | |
|---|---|---|---|
| 1,197,637 | 9/1916 | Johnson | 415/91 |
| 2,656,809 | 10/1953 | Frasure | 416/189 |
| 2,962,206 | 11/1960 | Borden et al. | 415/143 |
| 2,984,189 | 5/1961 | Jekat | 415/74 |
| 3,804,553 | 4/1974 | Hickey, Jr. | 416/189 |

FOREIGN PATENT DOCUMENTS

| | | | |
|---|---|---|---|
| 710725 | 8/1931 | France | 415/143 |
| 751416 | 9/1933 | France | 415/143 |
| 25608 | of 1905 | United Kingdom | 416/189 |

*Primary Examiner*—Leonard E. Smith

*Attorney, Agent, or Firm*—Emrich, Root, O'Keefe & Lee

[57] ABSTRACT

A centrifugal impeller for use in a combination centrifugal-turbine pump capable of pumping liquids at or near the boiling point thereof with suction heads not greater than about one foot and wherein the entrance portion of the centrifugal impeller includes one or more of vane inserts removably mounted therein, with adjacent ones of the inserts having vanes that are aligned with each other to define liquid-feeding spiral vanes that extend through the plurality of inserts.

6 Claims, 6 Drawing Figures

CENTRIFUGAL IMPELLERS

BACKGROUND OF THE INVENTION

This invention relates to combination centrifugal-turbine pumps, and, more particularly to centrifugal impellers for use in centrifugal-turbine pumps.

It is a primary object of the present invention to afford a novel centrifugal impeller for use in combination centrifugal-turbine pumps.

Centrifugal-turbine pumps for pumping liquids at or near the boiling point with suction heads not greater than about one foot have been heretofore known in the art, being disclosed, for example, in U.S. Pat. No. 2,875,698, issued to L. C. Roth, in my earlier U.S. Pat. No. 3,614,256 and in my earlier filed application for U.S. Pat. Ser. No. 167,988, filed Aug. 2, 1971, now abandoned. It is another object of the present invention to afford improvements over combination centrifugal-turbine pumps heretofore known in the art.

Centrifugal impellers for use in centrifugal-turbine pumps, and which impellers embody vanes in the entrance portion thereof have been heretofore known in the art, being shown, for example, in my aforementioned application, Ser. No. 167,988 and in U.S. Pat. No. 2,902,941, issued to Y. Kiba and U.S. Pat. No. 2,984,189, issued to W. K. Jekat. It is a further object of the present invention to afford improvements over centrifugal impellers heretofore known in the art.

Another object of the present invention is to afford a novel centrifugal impeller for use in centrifugal-turbine pumps embodying vanes constituted and arranged in a novel and expeditious manner in the entrance portion of the impeller.

Another object is to enable the vane portion of such an impeller to be manufactured in a novel and expeditious manner.

Yet another object of the present invention is to afford a novel centrifugal impeller of the aforementioned type wherein the vanes are afforded in one or more novel inserts mounted in the impeller in a novel and expeditious manner.

A further object of the present invention is to afford a novel centrifugal impeller of the aforementioned type which is practical and efficient in operation, and which may be readily and economically produced commercially.

Other and further objects of the present invention will be apparent from the following description and claims and are illustrated in the accompanying drawing which, by way of illustration, show the preferred embodiments of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENTS SHOWN HEREIN

Figure 1:
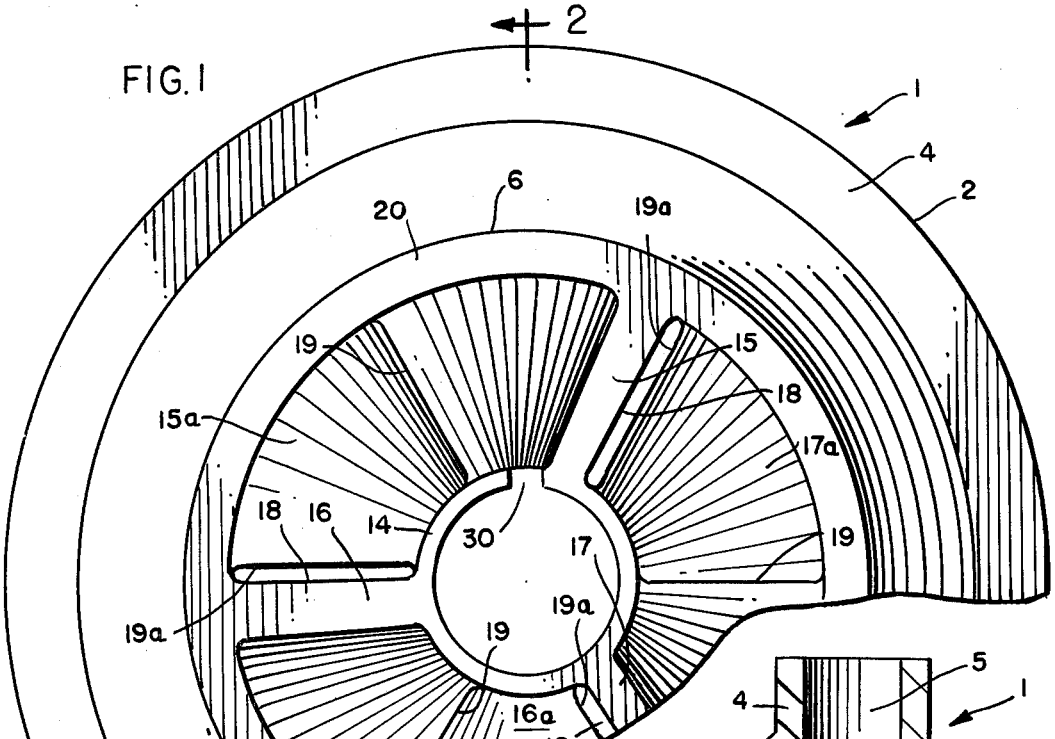
FIG. 1 is a fragmentary front elevational view of a centrifugal impeller embodying the principles of the present invention.

A centrifugal impeller, embodying the principles of the present invention, is shown in FIGS. 1-6 of the drawings to illustrate the presently preferred embodiment of the present invention. The impeller 1 is of the same general type as the centrifugal impellar shown in my aforementioned U.S. Pat. No. 3,614,256 although it differs therefrom, and, like the centrifugal impeller shown in the last mentioned patent, embodies a one-piece housing 2 having a rear wall 3 and a front wall 4 defining discharge passageways 5, and with an entrance portion in the form of an elongated tubular member 6, which is intregal with the front wall 4 and preferably is substantially round in transfer cross section, projecting forwardly from the front wall 4 to afford an entrance opening 7 for the impeller 1. The rear wall 3 has an opening 8 extending therethrough, and a cylindrical or tubular hub 9, which is integral with the rear wall 3, projects rearwardly therefrom in axial alignment with the opening 8, FIG. 2. The hub 9 has a keyway 10formed therein for keying housing 2 to a drive shaft, not shown, in a manner well known in the art.

Figure 2:
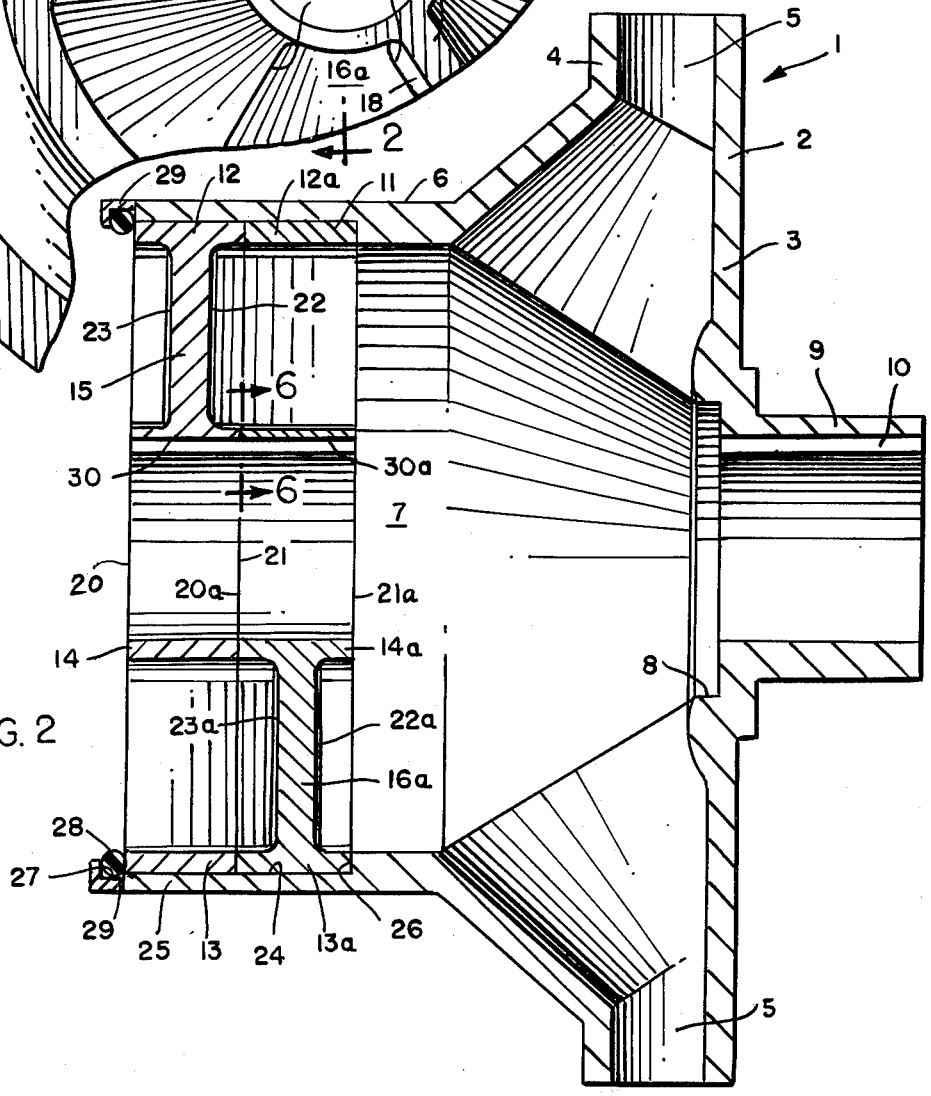
FIG. 2 is a cross sectional view taken substantially along the line in 2—2 in FIG. 1.

A vane assembly 11, FIG. 2, embodying two vane inserts 12 and 12*a*, is mounted in the entrance opening 7 of the impeller 1.

The vane insert 12, FIGS. 2-5, embodies an outer annular flange 13 and an inner annular hub 14, disposed in concentric relation to each other, with three equally spaced vanes 15, 16 and 17 extending radially between the flange 13 and the hub 14.

Figure 5:
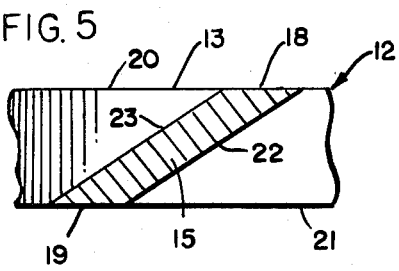
FIG. 5 is a detail sectional view taken substantially along the line 5—5 in FIG. 3.
Figure 4:
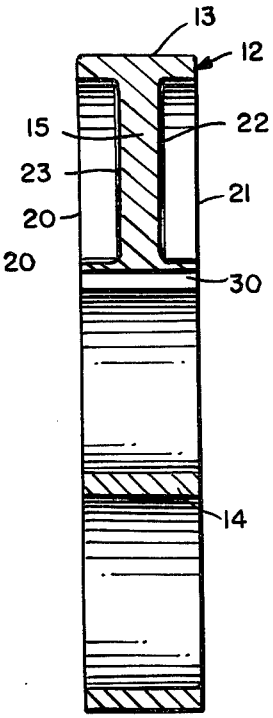
FIG. 4 is a cross sectional view taken substantially along the line 4—4 in FIGS. 3.

The flange 13 and the hub 14 are of the same width, FIGS. 2 and 4, and each of the vanes 15-17 extends across the entire width of the flange 13 and the hub 14, terminating at its front and rear edge portions 18 and 19, respectively, in uniplanar relation to the front face 20 and the rear face 21, respectively, of the vane insert 12, FIG. 5. Each of the vanes 15-17 embodies a front face 22 and a rear face 23 and is so disposed between the flange 13 and the hub 14 that the front face 22 thereof is disposed at a rearwardly opening obtuse angle to the front face 20 of the vane insert 12, FIG. 5.

The vane insert 12*a* is identical in construction to the vane insert 12, except for the positioning of a keyway, as will be discussed in greater detail presently, and parts thereof are indicated in the drawings by the same reference numerals as those used to indicate parts of the vane insert 12, but with a suffix "a" added thereto.

The tubular member 6 of the housing 2 has an annular recess 24 formed in the interior of the front end portion 25 thereof, FIG. 2. The recess 24 terminates at its inner end in a shoulder 26, and has a snap-ring groove 27 formed around the interior of the outer end portion thereof for a purpose which will be discussed in greater detail presently.

The recess 24 is of such circumferential size that it will receive the vane inserts 12 and 12*a* therein with a slip fit; and is one of such depth that when the vane inserts 12 and 12*a* are disposed therein in side-by-side, or laterally stacked relation to each other, with the rear face 21*a* of the vane insert 12*a* disposed in abutting engagement with the shoulder 26, a snap ring, such as the snap ring 28, shown in FIG. 2, when disposed in the groove 27, is effective to hold the vane inserts 12 and 12*a* in the recess 24 in abutting engagement with each other. Openings, such as the openings 29, FIG. 2, may be afforded through the front end portion 25 of the tubular member 6, in radial alignment with the snap ring groove 27 so that a suitable tool may be inserted therethrough to dislodge the snap ring 28 from the groove 27 when it is desired to remove the vane inserts 12 and 12*a* from the recess 24.

When the vane inserts 12 and 12*a* are disposed in operative position in the recess 24, the forward edge portion 18 of each of the vanes 15*a*–17*a* of the vane insert 12*a* is disposed directly rearwardly of, and in closely adjacent, parallel relation to the rear edge portion 19 of each of the vanes 15–17, respectively, of the vane insert 12. With the vane inserts 12 and 12*a* so disposed relative to each other, the vanes 15–17 in the vane insert 12 are aligned with each of the vanes 15*a*–17*a* of the vane insert 12*a* in such a manner that each pair of thus aligned vanes affords a spiral-shaped vane extending inwardly from the front edge of the tubular number 6 toward the rear wall 3 of the housing 2, so that when the impeller 1 is mounted in a combination centrifugal-turbine pump and is rotated in a clockwise direction, as viewed in FIGS. 1 and 3, the front faces 22–22*a* ease the liquid entering the entrance 7 of the impeller 1 into a rotational movement by virtue of the turning of the spiral vanes 15—15*a*, 16—16*a*, and 17—17*a*, as the liquid passes toward the rear wall 3 of the housing 2, and, in addition, imparts an axial velocity to the liquid and increases its pressure. These forces combine to prevent the high rotational velocity of the rearward portion of the impeller 1 from causing the liquid to flash into vapor. The liquid entering the rear portion of the housing 2 of the impeller 1, from the enterance portion 6 thereof, is discharged therefrom through the passageways 5 in the usual manner.

Figure 3:
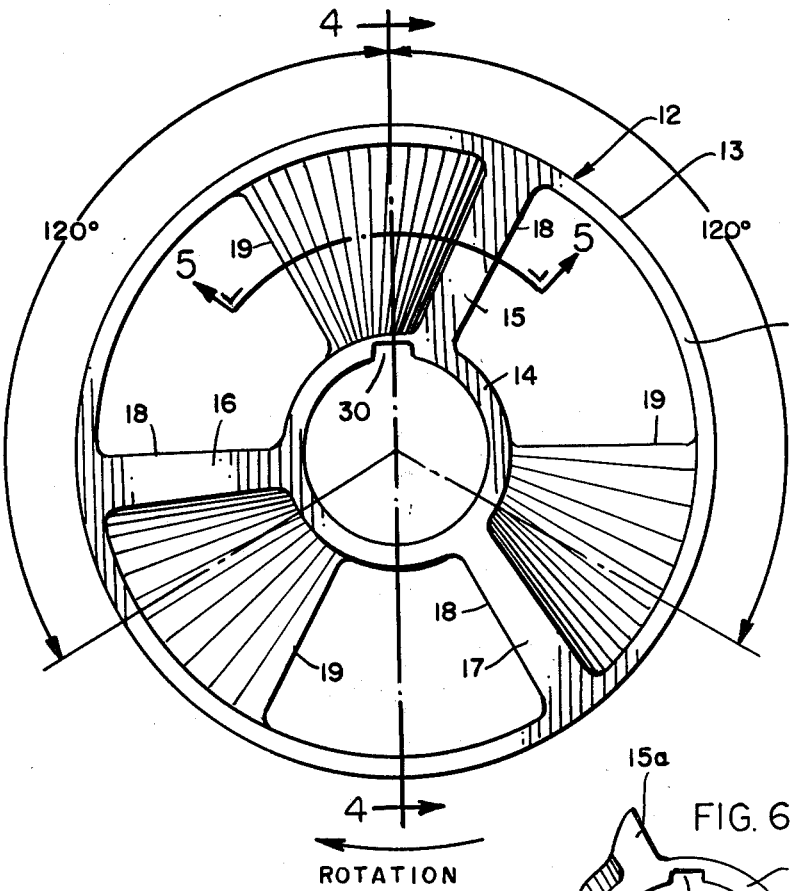
FIG. 3 is a front elevational view of a vane insert, which forms part of the impeller shown in FIGS. 1 and 2.
Figure 6:
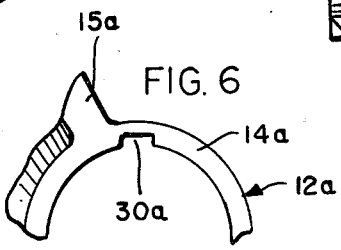
FIG. 6 is a detail sectional view taken substantially along the line 6—6 in FIG. 2.

In the preferred embodiment of the present invention, keyways 30 and 30*a* are formed in the interiors of the hubs 14 and 14*a*, respectively, FIGS. 3 and 6, in such position that by properly aligning the keyways 30 and 30*a*, when the vane inserts 12 and 12*a* are disposed in operative position in the recess 24 in the tubular number 6, the vane inserts 12 and 12*a* are automatically disposed in such position relative to each other that the vanes 15–17 of the vane insert 12 are properly aligned with the vanes 15*a*–17*a*, respectively, of the vane insert 12*a*. This, or course, means that for the vane inserts 12 and 12*a*, the keyway 30*a* is offset to the right, or in a clockwise direction, as viewed in FIGS. 3 and 6, with respect to the keyway 30 in the vane insert 12 the same amount that the vane insert 12*a* is offset in a counter-clockwise direction relative to the vane insert 12 when the vane inserts 12 and 12*a* are disposed in the aforementioned operative position to each other in the tubular number 6. With this construction, both of the vane inserts 12 and 12*a* may be secured to a drive shaft, not shown, of the pump by a single key or spine on the shaft. With such construction, it will be seen that the vane inserts 12 and 12*a* may be quickly and easily properly positioned in the tubular number 6 of the housing 2, and may be quickly and easily secured to a suitable drive shaft of a centrifugal-turbine pump, not shown, for rotation therewith.

Figure 7:
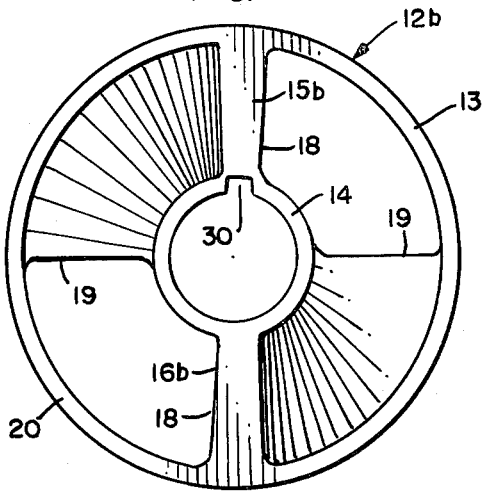
FIG. 7 is a front elevational view, similar to FIG. 3, but showing a modified form of the present invention.

In FIG. 7, a somewhat different form of impeller insert is shown to illustrate a modified form of the present invention, and parts which are identical to parts shown in FIGS. 1–6 are indicated by the same reference numerals and parts which are similar to parts shown in FIGS. 1–6 are indicated by the same reference numerals with the suffix "b" added.

The vane insert 12*b* shown in FIG. 7 basically is the same in construction as the vane insert 12 shown in FIGS. 1–5 except that it only embodies two vanes 15*b* and 16*b*, spaced 180 degrees from each other rather than the three vanes 15–17, spaced 120 degrees from each other, as embodied in the vane insert 12.

Like the vane insert 12, the vane insert 12*b* embodies an outer annular flange 13 and an inner annular hub 14 disposed in concentric relation to each other, with the hub 14 having a keyway 30 formed therein.

Like the vanes 15–17 in vane insert 12, the vanes 15*b* and 16*b* extend across the entire width of the flange 13 of the vane insert 12*b* and, of course, being greater in length annularly of the vane insert 12*b*, are disposed at a greater obtuse angle to the front face 20 of the vane insert 12*b*.

Preferably, the vane insert 12*b* will be used in an assembled centrifugal-turbine pump in conjunction or combination with additional vane inserts having the same construction, except that the keyway in the additional vane insert or inserts would be offset in a clockwise direction from the position of the keyway 30, shown in FIG. 7, in a manner similar to that in which the keyway 30*a* of the vane insert 12*a* is offset from the keyway 30 in the vane insert 12 in the form of the present invention illustrated in the FIGS. 1–6. In this instance, the keyways would be offset from each other a sufficient distance so as to dispose the leading edge portions 18 of the vanes 15*b* and 16*b* of the additional vane inserts in axial alignment with a rear edge portions 19 of the vanes 15*b* and 16*b*, respectively, of the next adjacent vane insert disposed forwardly thereof as will be appreciated by those in the art.

Impeller inserts embodying three vanes, FIGS. 1–5, and two vanes, FIG. 7, are shown herein only by way of illustration and not by way of limitation of the broader aspects of the present invention. A greater or lesser number of vanes may be used in the individual impeller inserts and a greater of lesser number of impeller inserts maybe used in the manner disclosed herein without departing from the broader aspects of the present invention. The matter of the number of vanes used in the impeller inserts and the matter of the number of impeller inserts to be used depends upon various factors, such as, for example, the airflow desired through the assembled unit, the rotational velocity and the axial thrust which it is desired to impart to the air, the speed of rotation of the centrifugal impeller, and the like.

However, in the practice of the present invention in accordance with the preferred form thereof, the leading and rear edges of the individual vanes in the individual impeller inserts will, in all instances, be spaced from the rear and leading edges, respectively, of the next adjacent vanes of that insert, so as to facilitate the manufacture of the vane inserts. As well be appreciated by those skilled in the art, with the vane inserts constructed in such a manner, with the individual vanes so spaced from each other and of relatively short length in an annular direction relative to the respective inserts in which they are embodied, the inserts may be readily manufactured by such means as, for example, by casting.

From the foregoing, it will be seen that the present invention affords a novel centrifugal impeller for use in a combination centrifugal-turbine pump.

Also, it will be seen that the present invention affords a novel impeller of the aforementioned type, which embodies vanes constituted and arranged in a novel and expeditious manner in the entrance portion thereof.

In addition, it will be seen that the present invention affords a novel impeller of the aforementioned type wherein the vanes may be readily manufactured and with an ease not heretofore known in the art.

Further, it will be seen that the present invention affords a novel centrifugal impeller which is practical and efficient in operation and which may be readily and economically produced commercially.

Thus, while I have illustrated and described the perferred embodiments of my invention, it is to be understood that these are capable of variation and modification, and I therefore, do not wish to be limited to the precise details set forth, but desire to avail myself of such changes and alterations as fall within the purview of the following claims.

I claim:

1. In a centrifugal impeller for use in a centrifugal-turbine pump capable of pumping liquids at or near the boiling point thereof with suction heads not greater than about one foot, the impeller including a housing having a front, elongated entrance portion through which such liquid enters said housing, and a rear discharge portion from which liquid entering said housing through said discharge portion is discharged from said housing during operation of said pump, and said pump including drive means including a drive shaft mounted in said housing and operatively connected thereto for rotating the latter, the combination of:

a. vane means removably mounted in said entrance portion for rotation therewith for feeding such liquid through said entrance portion to said discharge portion during such rotation of said housing with said drive shaft, b. said vane means comprising
  (1) a vane insert comprising
    (a) an outer annular flange,
    (b) an annular hub disposed inside said flange in substantially concentric relation thereto, and
    (c) a plurality of vanes extending between said flange and hub in annularly spaced relation to each other, c. said vane insert being mounted in said entrance portion for rotation therewith, with
  (1) the outer peripheral surface of said flange being disposed in closely adjacent relation to the inner surface of said entrance portion, and
  (2) said hub being mounted on and secured to said drive shaft for rotation with said drive shaft and said housing during operation of said pump, d. said flange having
  (1) a front face through which such liquid enters in entering into said entrance portion, and
  (2) a rear face through which said liquid exits in flowing through said entrance portion to said discharge portion, and e. each of said vanes having a front face,
  (1) facing in the direction of rotation of said impeller insert when the latter is so rotating with said drive shaft, and
  (2) disposed at a rearwardly opening obtuse angle to said front face of said flange.

2. A centrifugal impeller for use in a combination centrifugal-turbine pump capable of pumping liquids at or near the boiling point thereof with suction heads not greater than about one foot and having a drive shaft rotatable therein during operation of said pump, said impeller comprising:

a. a housing adapted to be mounted on and secured to such a drive shaft for rotation therewith and comprising
  (1) a front tubular entrance portion for feeding such liquid into said housing, and
  (2) a rear portion having discharge passageways therein for discharging such liquid from said housing, b. a vane assembly comprising a plurality of vane inserts removably mounted in said entrance portion, c. each of said vane inserts comprising
  (1) an outer annular flange,
  (2) an annular hub disposed on the axial center of said flange in inwardly spaced substantially concentric relation to said flange, and
  (3) a plurality of vanes extending between said flange and said hub, d. each of said flanges having a front face and a rear face defining the respective, axially spaced, opposite sides thereof, e. each of said vanes in each of said vane inserts
  (1) extending between said front face and said rear face of said flange in said insert,
  (2) having
    (a) a front face disposed at an obtuse angle to said front face of said last mentioned flange,
    (b) a rear face disposed at an acute angle to said last mentioned front face,
    (c) a front edge disposed adjacent to said front face of said last mentioned flange, and
    (d) a rear edge disposed adjacent to said rear face of said last mentioned flange, f. said vane inserts being mounted in said entrance portion in side-by-side relation to each other, with
  (1) the outer peripheries of said flanges thereof disposed in closely adjacent relation to the inner peripheral surface of said entrance portion,
  (2) the hubs thereof disposed in position to be mounted on and secured to said drive shaft when said housing is so mounted on and secured to the latter for rotation therewith,
  (3) said front faces of said vanes thereof facing in the direction of rotation of said inserts when the latter are so rotated by said drive shaft, and
  (4) said rear edges of said vanes of each of said vane inserts, which is disposed adjacent to a vane insert in the direction toward said rear portion of said housing, are aligned with said front edges of respective ones of said vanes of said vane insert, which is so adjacent, in adjacent, parallel relation thereto, and g. means for releasably holding said vane inserts in said housing.

3. A centrifugal impeller as defined in claim 2, and in which a. said means for releasably holding said vane inserts in said entrance portion comprises (1) a recess formed in the interior of said entrance portion at the end thereof remote from said rear portion for receiving said vane inserts therein, (2) a shoulder defining the inner end of said recess for limiting movement of said vane inserts into said entrance portion, and (3) a snap-ring removably mounted in said recess at the side of the latter remote from said shoulder.

4. A centrifugal impeller as defined in claim 2, and in which a. each respective set of said aligned respective vanes in said plurality of vane inserts defines a continuous spiral that progresses along said tubular entrance portion toward said rear portion from the end portion of said tubular entrance portion remote from said rear portion.

5. A centrifugal impeller as defined in claim 2, and in which a. in each of said impeller inserts said front edges and said rear edges of each of said vanes thereof are spaced annularly around said impeller from said rear and front edges, respectively, of the next adjacent ones of said vanes therein.

6. A centrifugal impeller as defined in claim 5, and in which a. said impeller inserts comprise metal castings.

* * * * *